US006182797B1

(12) United States Patent
Tebbe et al.

(10) Patent No.: US 6,182,797 B1
(45) Date of Patent: Feb. 6, 2001

(54) ENHANCED VISIBILITY RIDER REACH FORK LIFT TRUCK

(75) Inventors: Patrick A. Tebbe, Anna, OH (US); Robert J. Henshaw, Atlanta, GA (US); Daniel C. Magoto, Russia, OH (US)

(73) Assignee: Crown Equipment Corporation, New Bremen, OH (US)

( * ) Notice: Under 35 U.S.C. 154(b), the term of this patent shall be extended for 0 days.

(21) Appl. No.: 09/270,619

(22) Filed: Mar. 17, 1999

Related U.S. Application Data

(60) Provisional application No. 60/078,243, filed on Mar. 17, 1998.

(51) Int. Cl.[7] ..... B66F 9/06
(52) U.S. Cl. ..... 187/227; 187/222
(58) Field of Search ..... 187/234, 222, 187/227, 272, 229

(56) References Cited

U.S. PATENT DOCUMENTS

| | | | | |
|---|---|---|---|---|
| 3,469,858 | | 9/1969 | Goodacre et al. | 280/93.506 |
| 3,542,161 | * | 11/1970 | Bronislaus | 187/222 |
| 4,030,568 | * | 6/1977 | Heinold | 187/227 |
| 4,191,276 | * | 3/1980 | Farmer et al. | 187/227 |
| 4,221,530 | * | 9/1980 | Williams, IV et al. | 414/673 |
| 4,287,966 | * | 9/1981 | Frees | 187/234 |
| 5,022,496 | * | 6/1991 | Klopfleisch et al. | 187/224 |
| 5,121,816 | * | 6/1992 | Curtin | 187/243 |
| 5,201,629 | * | 4/1993 | Simpson et al. | 414/632 |
| 5,462,136 | * | 10/1995 | Schoenmaker et al. | 187/223 |
| 5,586,620 | | 12/1996 | Dammeyer et al. | 187/227 |
| 5,738,187 | * | 4/1998 | Dammeyer et al. | 187/222 |
| 5,890,562 | * | 4/1999 | Bartels et al. | 187/222 |
| 5,918,703 | * | 7/1999 | Nordstrom et al. | 187/234 |
| 6,000,502 | * | 12/1999 | Leasor et al. | 187/222 |

FOREIGN PATENT DOCUMENTS

| | | | | |
|---|---|---|---|---|
| 113551 | * | 3/1969 | (KG) | 187/272 |

* cited by examiner

*Primary Examiner*—Dean J. Kramer
*Assistant Examiner*—Paul T. Chin
(74) *Attorney, Agent, or Firm*—King & Schickli PLLC

(57) ABSTRACT

A fork lift truck is provided comprising: a power unit including an operator's compartment and at least one equipment compartment; a pair of forks; a fork carriage assembly coupled to the forks; and a mast assembly. The mast assembly is coupled to the fork carriage assembly and the power unit for vertically moving the fork carriage assembly including the forks relative to the power unit. A hydraulic pump system is also provided. It has at least one hydraulic motor/pump assembly mounted in the at least one equipment compartment and at least one fluid reservoir located laterally of the mast assembly.

18 Claims, 8 Drawing Sheets

12
14
10a
10
16
20

ENHANCED VISIBILITY RIDER REACH FORK LIFT TRUCK

CROSS-REFERENCE TO RELATED APPLICATION

This application claims the benefit of U.S. Provisional Application No. 60/078,243, filed Mar. 17, 1998, and entitled ENHANCED VISIBILITY RIDER REACH FORK LIFT TRUCK, which is incorporated herein by reference.

BACKGROUND OF THE INVENTION

This invention relates to a rider reach truck with improved visibility.

A typical rider reach truck includes a power unit, a pair of forks, a fork carriage assembly coupled to the forks and an upwardly extensible mast assembly coupled to the fork carriage assembly and the power unit for vertically moving the fork carriage assembly including the forks relative to the power unit. The power unit includes an operator's compartment, typically located at the right rear of the truck, a battery compartment, and first, second and third equipment compartments.

The battery compartment, located immediately behind the mast assembly and forward of the operator's compartment, has a minimum height that is determined by the capacity of the battery.

The first equipment compartment includes the space on the left rear of the truck; the second equipment compartment includes the space above the battery compartment; and the third equipment compartment includes the space behind an operator's back rest in the operator's compartment. Within the first equipment compartment are a traction motor/brake assembly, a power steering motor, and a hydraulic fluid reservoir. During operation of the truck, the fluid within the fluid reservoir, which is located adjacent to the operator's compartment, increases in temperature. Heat from the fluid reservoir is transferred to the operator's compartment which causes the temperature in the operator's compartment to increase.

A plurality of hydraulic motor/pump assemblies and an electronic controller for controlling the traction motor of the motor/brake assembly are located in the second equipment compartment above the battery compartment. The motor/pump assemblies are relatively large. Hence, they result in a limited forward view near the front of the truck because of the overall height of the truck in the area in front of the operator.

Since the forward visibility of rider reach trucks near the front of the power unit is limited by the height of the truck, it would be desirable to reduce the height of the truck above the battery compartment as much as possible. It would also be desirable to reduce heat transfer from the hydraulic fluid reservoir to the operator's compartment.

SUMMARY OF THE INVENTION

The height of at least a portion of the power unit of each of the rider reach trucks constructed in accordance with the present invention is reduced when compared to that of prior art rider reach trucks. Further with regard to the trucks of the present invention, a hydraulic motor/pump assembly previously associated with a power steering motor has been eliminated. The function performed by the eliminated motor/pump assembly is now performed by one of two remaining hydraulic motor/pump assemblies. The two remaining hydraulic motor/pump assemblies are located below the upper level of the battery compartment. At least one low-profile controller can be positioned above the battery compartment, the overall height of the power unit is substantially reduced so as to permit improved operator visibility. Additionally, the trucks of the present invention include one or two hydraulic fluid reservoirs which are located away from the operator's compartment so as to reduce heat transfer from those reservoirs to the operator's compartment. It is also noted that fuses behind the operator's back have been reduced in dimension when compared to prior art trucks to allow the back of the operator to be placed closer to the right side of the vehicle. This is advantageous because it allows for more room in the operator's compartment and allows the operator to have improved visibility around the right hand side of the mast.

In accordance with a first aspect of the present invention, a fork lift truck is provided comprising: a power unit including an operator's compartment and at least one equipment compartment; a pair of forks; a fork carriage assembly coupled to the forks; and a mast assembly coupled to the fork carriage assembly and the power unit for vertically moving the fork carriage assembly including the forks relative to the power unit. A hydraulic pump system is also provided. It has at least one hydraulic motor/pump assembly mounted in the at least one equipment compartment and at least one fluid reservoir located laterally of the mast assembly.

In a first embodiment of this aspect of the present invention, a pair of fluid reservoirs is provided. One fluid reservoir is located on each side of the mast assembly and is positioned adjacent to an outer surface of a front wall of the power unit. A first equipment compartment is located in a rear corner of the power unit opposite the front wall of the power unit. A second equipment compartment includes the space behind an operator's back rest in the operator's compartment.

In a second embodiment of this aspect of the present invention, first, second and third equipment compartments are provided. The first equipment compartment is located in a rear left comer of the power unit. It houses a traction motor/brake assembly coupled to a wheel which together effect movement of the power unit. The second equipment compartment is located on a side of the power unit and forward of the operator's compartment. The third equipment compartment includes the space behind an operator's back rest in the operator's compartment. One fluid reservoir is provided. It is located on a front corner of the power unit adjacent the second equipment compartment and laterally of the mast assembly.

A fork lift truck constructed in accordance with a second aspect of the present invention is provided. It comprises a power unit including an operator's compartment, at least one equipment compartment, and a battery compartment housing a battery located forward of the operator's compartment. The height of at least a portion of the power unit is limited to approximately the height of the battery compartment. The truck further comprises: a pair of forks; a fork carriage assembly coupled to the forks; a mast assembly coupled to the fork carriage assembly and the power unit for vertically moving the fork carriage assembly including the forks relative to the power unit; and a hydraulic pump system. The pump system comprises at least one hydraulic motor/pump assembly mounted in the at least one equipment compartment, at least one fluid reservoir, a manifold and conduits coupling the at least one motor/pump assembly and the at least one fluid reservoir to the manifold. The at least one fluid reservoir is located laterally of the mast assembly.

In a first embodiment of this aspect of the present invention, a pair of fluid reservoirs is provided. One fluid reservoir is located on each side of the mast assembly and is positioned adjacent to an outer surface of a front wall of the power unit. A first equipment compartment is located in a rear comer of the power unit opposite the front wall of the power unit. A second equipment compartment includes the space behind an operator's back rest in the operator's compartment. A third equipment compartment includes the space above the battery compartment. The hydraulic pump system further includes a controller mounted above the battery compartment. The manifold is also mounted above the battery compartment, forward of the operator's compartment and positioned along a first edge of the power unit such that the height of the power unit from a second edge of the power unit opposite to the first edge to the manifold is limited to approximately the height of the battery compartment.

In a second embodiment of this aspect of the present invention, first, second, third and fourth equipment compartments are provided. The first equipment compartment is located in a left rear comer of the power unit. It houses a traction motor/brake assembly coupled to a wheel which together define a drive mechanism for effecting movement of the power unit. The second equipment compartment is located on a right hand side of the power unit, forward of the operator's compartment and in-line with the battery compartment. The third equipment compartment includes the space behind an operator's back rest in the operator's compartment. The fourth equipment compartment includes the space above the battery compartment. One fluid reservoir is provided. It is located on a front comer of the power unit adjacent the second equipment compartment and laterally of the mast assembly. Two hydraulic motor/pump assemblies are provided. They are mounted in the second equipment compartment. The manifold is mounted above the two hydraulic motor/pump assemblies. The power unit further includes a drip shelf positioned between the manifold and the motor/pump assemblies. The hydraulic pump system further includes a low profile first controller mounted above the battery compartment. The drive mechanism further includes a second controller mounted laterally of the mast assembly and opposite to the fluid reservoir.

DETAILED DESCRIPTION OF THE INVENTION

Figure 1:
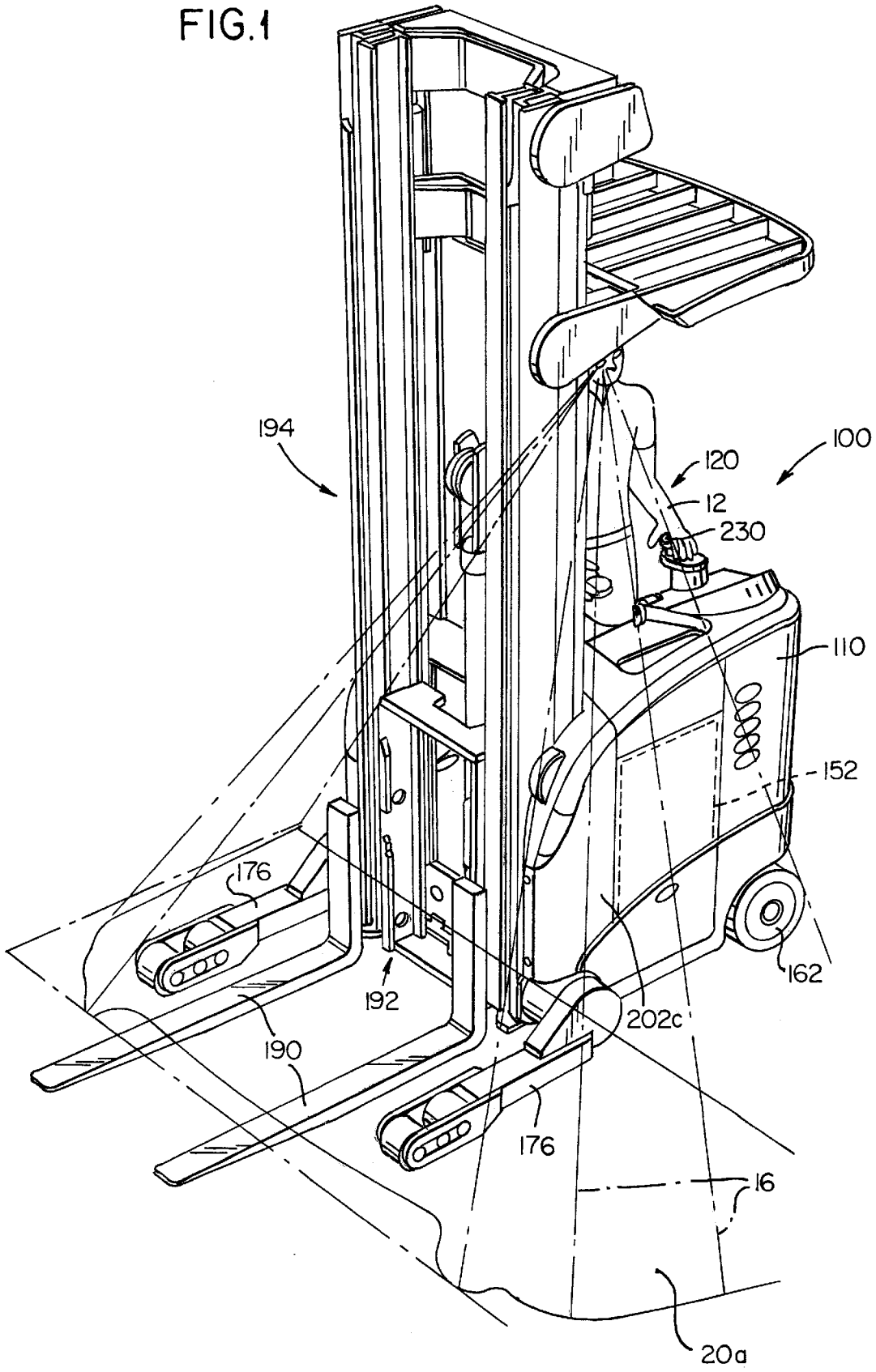
FIG. 1 is a perspective view of a rider reach fork lift truck constructed in accordance with a first embodiment of the present invention with ray-traces showing the improved visibility pattern resulting from the present invention.

FIG. 1 illustrates a rider reach fork lift truck 100 constructed in accordance with a first embodiment of the present invention. The truck 100 includes a power unit 110 comprising an operator's compartment 120, first, second and third equipment compartments 130, 140, 145, and a battery compartment 150 located forward of the operator's compartment 120, see FIGS. 2, 5, 6 and 7. A battery 152 is housed within the compartment 150. It supplies power to a traction motor/brake assembly 160, see FIG. 5, coupled to a steerable wheel 162 and to two hydraulic motor/pump assemblies 170 and 172. The assemblies 170 and 172 supply power to several different systems, such as mast, fork and reach hydraulic cylinders and to a steering control unit (not shown) which is controlled by a steering control or tiller 230. The steering control unit, in turn, supplies power to a power steering motor 180. In a prior art fork lift truck, three hydraulic motor/pump assemblies were required to supply power to the mast, fork and reach hydraulic cylinders and to a steering torque generator. In the present invention, one of those motor/pump assemblies has been eliminated as the remaining two motor/pump assemblies perform all of the same or equivalent functions previously performed by three motor/pump assemblies. The traction motor/brake assembly 160, the steerable wheel 162 and a flat-pack electronic controller 164 define a drive mechanism for effecting movement of the truck 100. A caster wheel 174, see FIGS. 6–10, is placed at the right rear of the truck 100 and a pair of outriggers 176 are located at the forward end of the truck 100.

The truck 100 further includes a pair of forks 190 mounted on a fork carriage assembly 192. The carriage assembly 192 is mounted to an extensible mast assembly 194 which, in turn, is coupled to the power unit 100. The mast assembly 194 moves the fork carriage assembly 192 and, hence, the forks 190, up and down relative to the power unit 110. The fork carriage assembly 192 and the mast assembly 194 can be constructed as described in U.S. Pat. No. 5,586,620, which is incorporated herein by reference.

Figure 2:
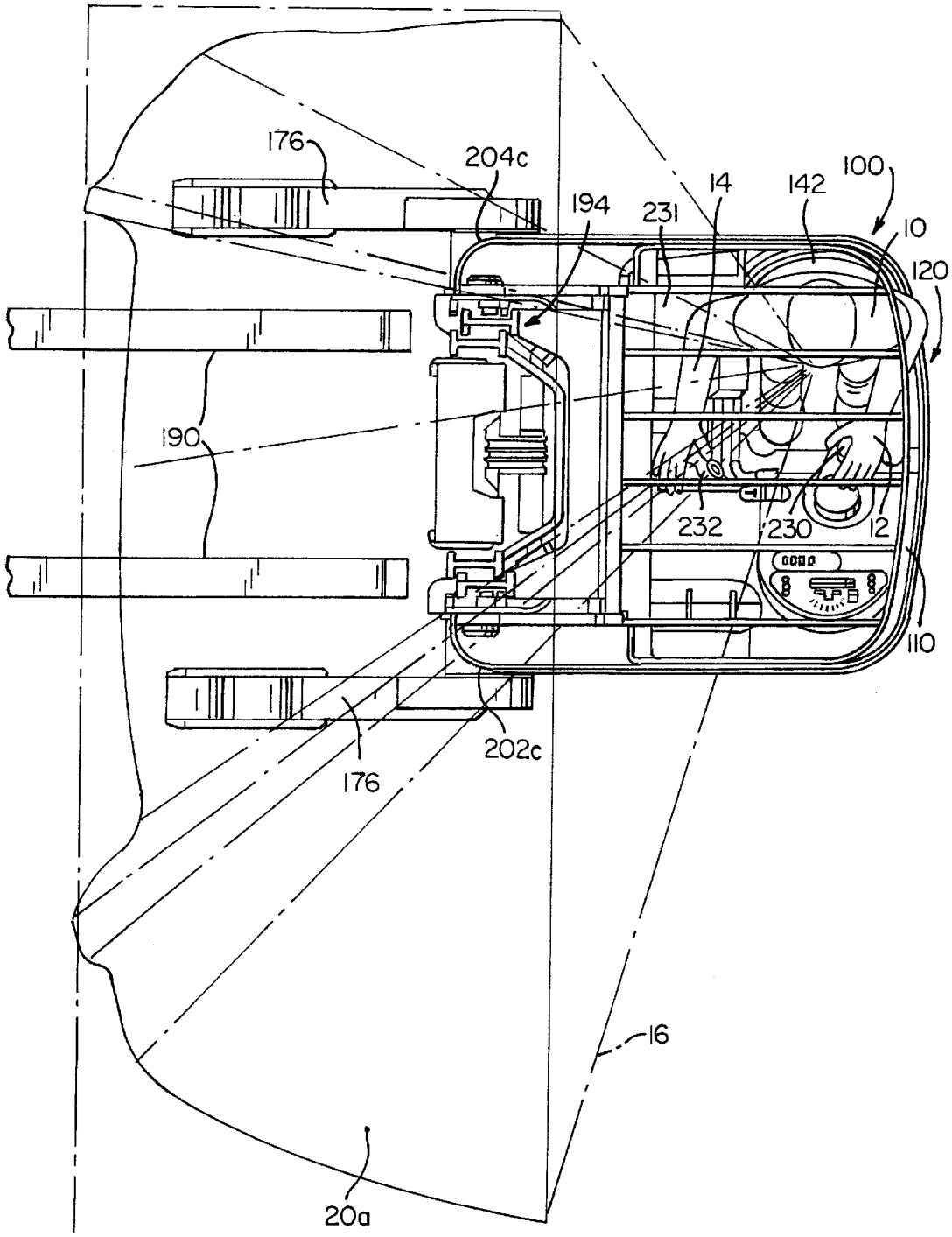
FIG. 2 is a plan view of the truck illustrated in FIG. 1.
Figure 5:
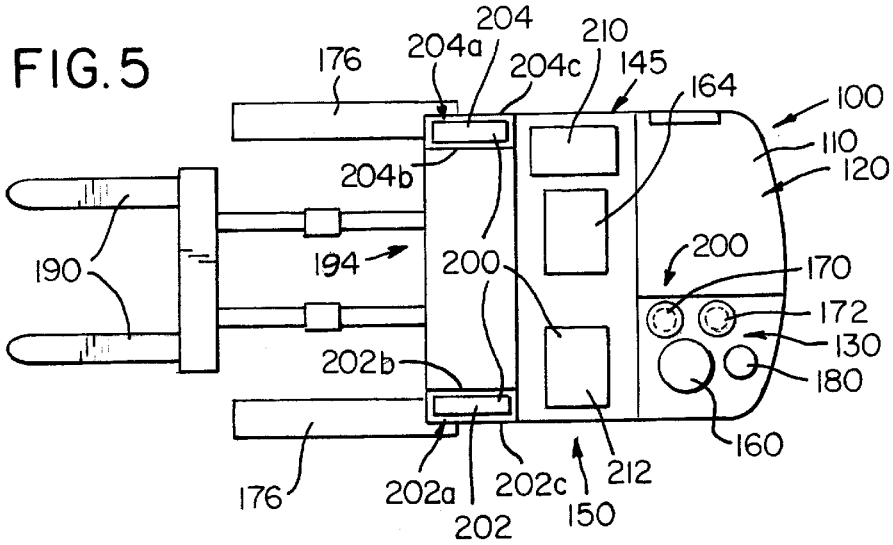
FIG. 5 is a simplified plan view of the truck constructed in accordance with the first embodiment of the present invention illustrated in FIG. 1.

The operator's compartment 120 is placed at the right rear of the truck 100 (with the front of the vehicle being in the direction of the forks), see FIGS. 2 and 5. An operator 10 stands in the compartment 120 with the operator's left hand 12 on the steering control 230 and the operator's right hand 14 on a control handle 232, which controls the vehicle speed, direction of travel, the raising and lowering of the forks 190 and other axillary functions, such as fork extension and side shift. The operator's back is supported by an operator's back rest 142.

During operation of the truck 100, the operator 12 will generally look over his/her right shoulder when the vehicle is traveling forward or forks first. Visibility in the forward direction is limited by the mast assembly 194, the forks 190, and the height of the power unit 110.

The first equipment compartment 130 is located in the left rear comer of the power unit 110. The second equipment compartment 140 includes space behind the operator's back rest 142, see FIG. 7. The third equipment compartment 145 includes space over the battery compartment 150.

The truck 100 further includes a hydraulic pump system 200. The system 200 comprises the two hydraulic motor/pump assemblies 170 and 172, which are located in the first equipment compartment 130, see FIG. 5. It further includes two hydraulic fluid reservoirs 202 and 204, a manifold 210 and conduits (not shown) coupling the motor/pump assemblies 170, 172 and the reservoirs 202 and 204 to the manifold 210. The two fluid reservoirs 202 and 204 are located laterally of the mast assembly 194, see FIGS. 5, 6, 8 and 10. They sit within two reservoir compartments 202*a* and 204*a* defined by two brackets 202*b* and 204*b* coupled to an outer surface 112 of a first wall 114 of the power unit 110, see FIG. 6, and a pair of outer guards or panels 202*c* and 204*c*, which form a portion of the overall outer surface of the power unit 110, see FIGS. 1 and 2. The guards 202*c* and 204*c* can be provided with vents. The pump system 200 also includes a flat-pack electronic controller 212 which controls the operation of the motor/pump assemblies 170, 172. The controller 212 is located in the third equipment compartment 145. It is also contemplated that the reservoirs 202 and 204 may be provided with cooling fins.

As noted above, in a prior art fork lift truck, the hydraulic fluid reservoir was located in the equipment compartment in the left rear of the truck. It was also positioned near the operator's compartment. During operation of the truck, the temperature of the fluid within the fluid reservoir would increase. Heat from the fluid reservoir would then be transferred to the operator's compartment causing an increase in temperature in the operator's compartment. In the present invention, the two hydraulic fluid reservoirs 202 and 204 are mounted outside of the power unit 110 and away from the operator's compartment 120. Hence, only a minimal amount of heat is transferred from the hydraulic reservoirs 202 and 204 to the operator's compartment 120 during operation of the vehicle.

A further advantage resulting from the positioning of the hydraulic reservoirs 202 and 204 outside of the power unit 110 is that additional storage space within the first equipment compartment 130 is made available. As noted above, a plurality of hydraulic motor/pump assemblies were located above the battery compartment in the prior art truck. Hydraulic motor/pump assemblies are relatively large. Hence, the assemblies resulted in a limited forward view near the front of the prior art truck. In the truck 100 of the present invention, the hydraulic motor/pump assemblies 170 and 172 are positioned in the first equipment compartment 130. Hence, the motor/pump assemblies 170 and 172 are not positioned above the battery compartment 150 so as to restrict the operator's forward visibility.

The manifold 210 is located in the third equipment compartment 145 above the battery compartment 150. A cover 231 is provided over the manifold 210. The cover 231 functions as an arm rest which is provided to assist the operator 12 in manipulating the control handle 232.

The controllers 164 and 212 are also located in the third equipment compartment 145 above the battery compartment 150. As they have only a limited thickness in a Z-direction, see FIG. 8, they do not appreciably restrict an operator's forward visibility.

Figure 7:
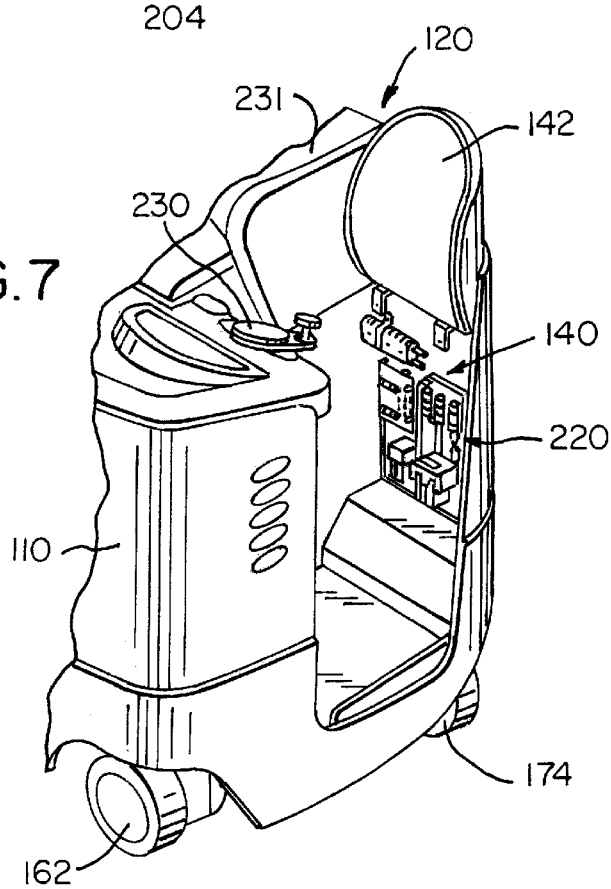
FIG. 7 is a rear perspective view of the power unit of the truck illustrated in FIG. 1 with a portion of the operator's back rest removed.
Figure 10:
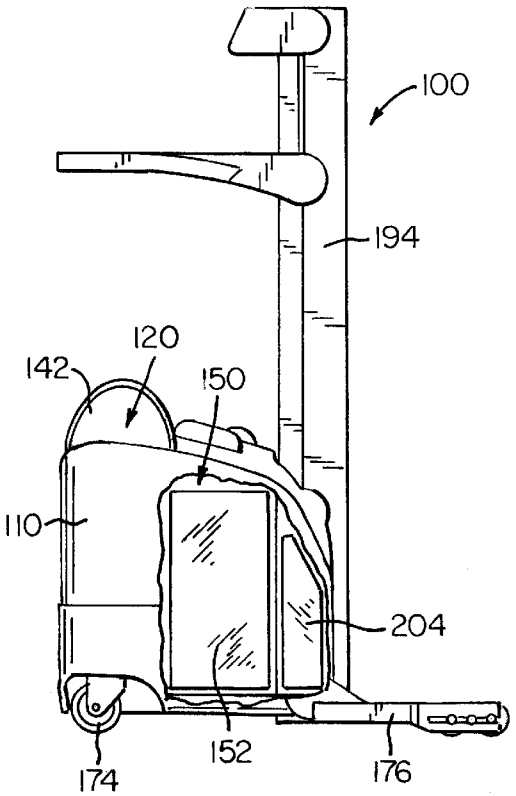
FIG. 10 is a right side view of the truck illustrated in FIG. 1, with a portion removed.
Figure 9:
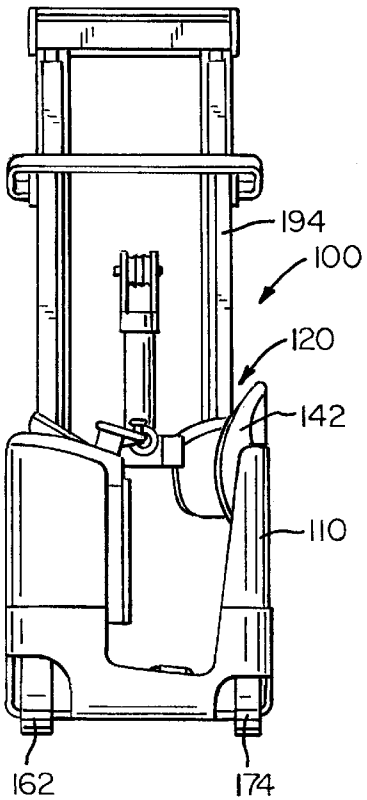
FIG. 9 is a rear view of the truck illustrated in FIG. 1.
Figure 8:
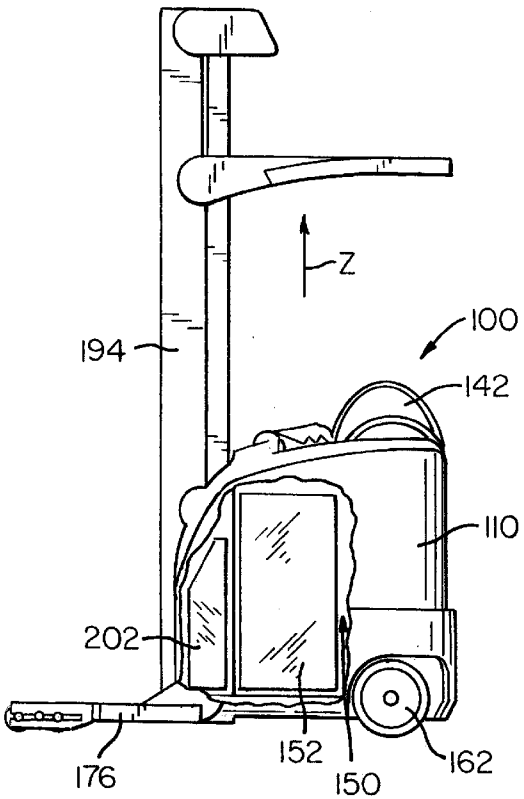
FIG. 8 is a left side view of the truck illustrated in FIG. 1, with a portion removed.
Figure 12:
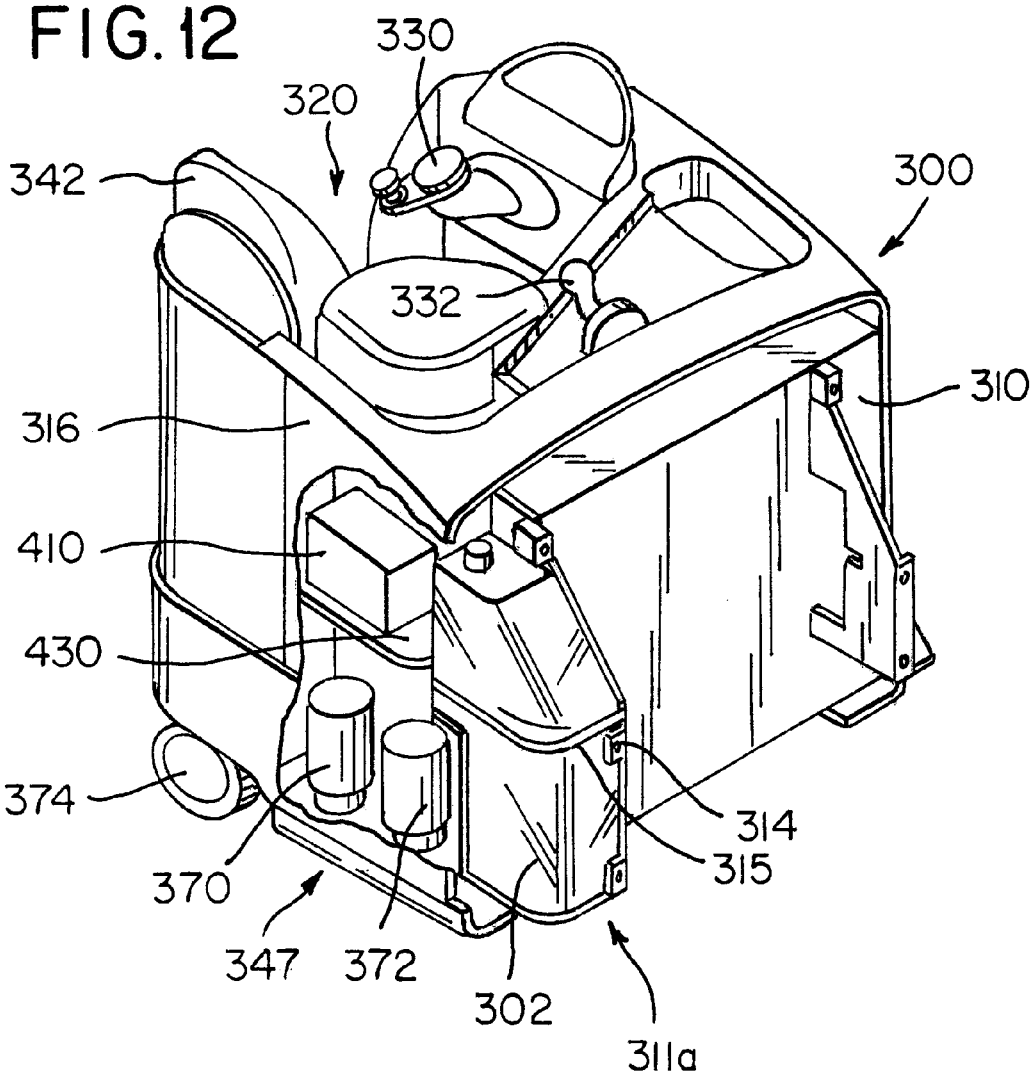
FIG. 12 is perspective view of a power unit of a truck constructed in accordance with a second embodiment of the present invention with a portion of its outer panels removed.

An electronic package 220 that includes fuses is located behind the operator's back rest 142. In FIG. 7, a portion of the back rest 142 has been removed to illustrate the electronic package 220. This package is considerably reduced in dimension over a similar package provided in the above-discussed prior art truck, and allows the operator's back to be placed closer to the right side of the vehicle. This is advantageous because it allows for more room in the operator's compartment 120 and allows the operator to have improved visibility around the right hand side of the mast assembly 194.

Figure 3:
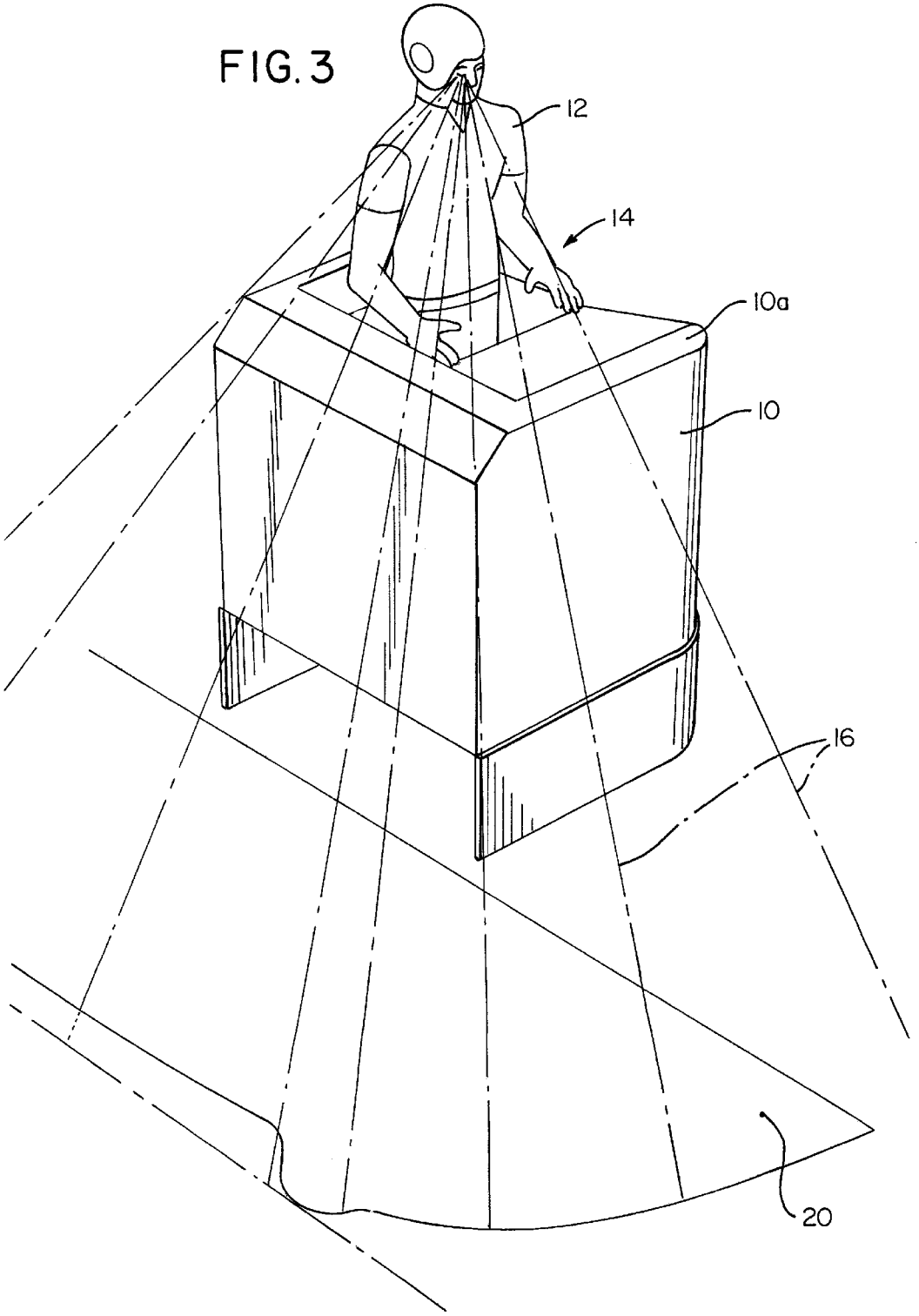
FIG. 3 is a simplified perspective view of a prior art rider reach truck and its visibility pattern.

FIG. 3 illustrates a prior art fork lift truck power unit 10. An operator 12 is shown in the vehicle's operator's compartment 14. The visibility near the truck is limited by the height of the power unit 10, as shown in FIG. 3. Ray-traces 16 from the eyes of the operator 12 show that an area 20 is blocked from the operator's vision due to the height of the outer shell 10*a* of the power unit 10 at the front of the truck. These ray-traces assume that the operator's head is stationary. Of course, by moving the head and body, greater visibility may be obtained in both the prior art truck and the truck 100 of the present invention, but for purposes of illustration and comparison, a stationary head is assumed.

Figure 4:
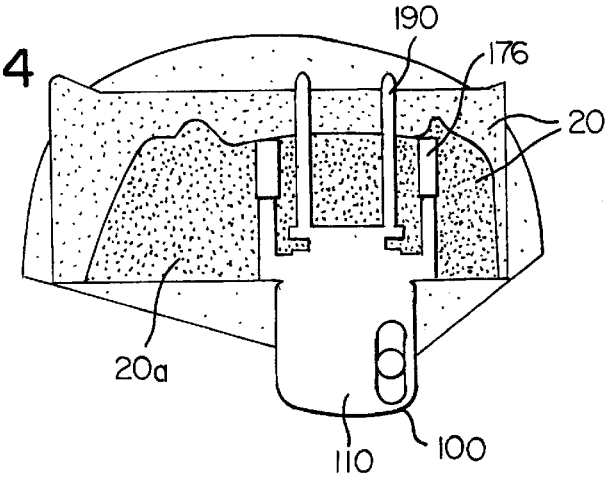
FIG. 4 is a simplified plan view comparing the visibility pattern of the truck illustrated in FIG. 1 with a prior art truck.

In the truck 100 of the present invention, on the other hand, lowering the profile of the power unit 100 as a result or relocating and consolidating some of the components, as described above, reduces the area 20*a* of limited visibility in front of the truck 100, see FIGS. 1 and 2. A comparison of the visibility aprons of both trucks is shown in FIG. 4. From this illustration, it is apparent that the area 20*a* blocked from view in the present invention is much smaller than in the prior art truck. More particularly, it can be seen that the blocked area to the front and to the left side of the truck 100 is significantly smaller for the truck 100 constructed according to the present invention.

The truck 100 illustrated in FIGS. 1, 2 and 5–10 is a 42" fork lift truck. That is, the power unit 110 spans 42 inches across its rear portion.

Figure 13:
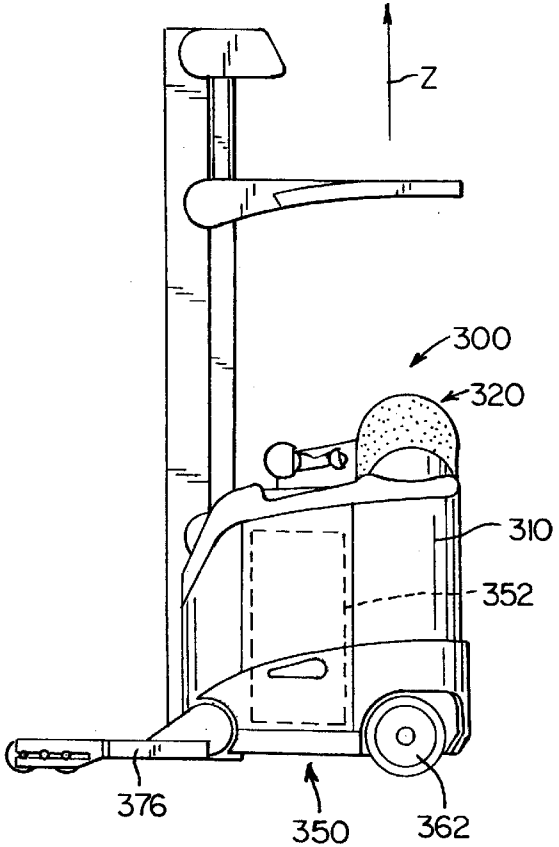
FIG. 13 is a left side view of the truck illustrated in FIG. 11.

A truck 300 constructed in accordance with a second embodiment of the present invention is illustrated in FIGS. 11–15. The truck 300 includes a power unit 310 comprising an operator's compartment 320, a first equipment compartment 330, a second equipment compartment (not shown), third and fourth equipment compartments 345 and 347, and a battery compartment 350 located forward of the operator's compartment 320, see FIG. 11. A battery 352, see FIG. 13, is housed within the compartment 350. It supplies power to a traction motor/brake assembly 360, see FIG. 11, coupled to a steerable wheel 362, see FIGS. 13 and 14, and to two hydraulic motor/pump assemblies 370 and 372, see FIGS. 11, 12 and 14. The assemblies 370 and 372 supply power to several different systems, such as mast, fork and reach hydraulic cylinders and to a power steering motor 380. The traction motor/brake assembly 360, the steerable wheel 362 and a flat-pack electronic controller 364 define a drive mechanism for effecting movement of the truck 300. A caster wheel 374 is placed at the right rear of the truck and a pair of outriggers 376 are located at the forward end of the vehicle.

The truck 300 further includes a pair of forks 390, a fork carriage assembly 392 and an extensible mast assembly 394 which are constructed and operate in substantially the same manner as the forks 190, the fork carriage assembly 192 and the extensible mast assembly 194 described above and illustrated in FIGS. 1 and 2.

Figure 11:
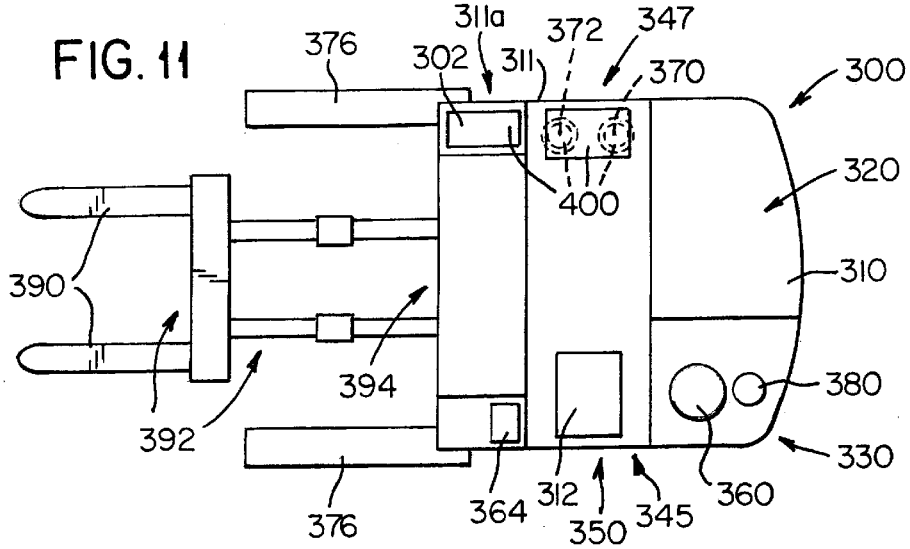
FIG. 11 is a simplified plan view of a truck constructed in accordance with a second embodiment of the present invention.
Figure 6:
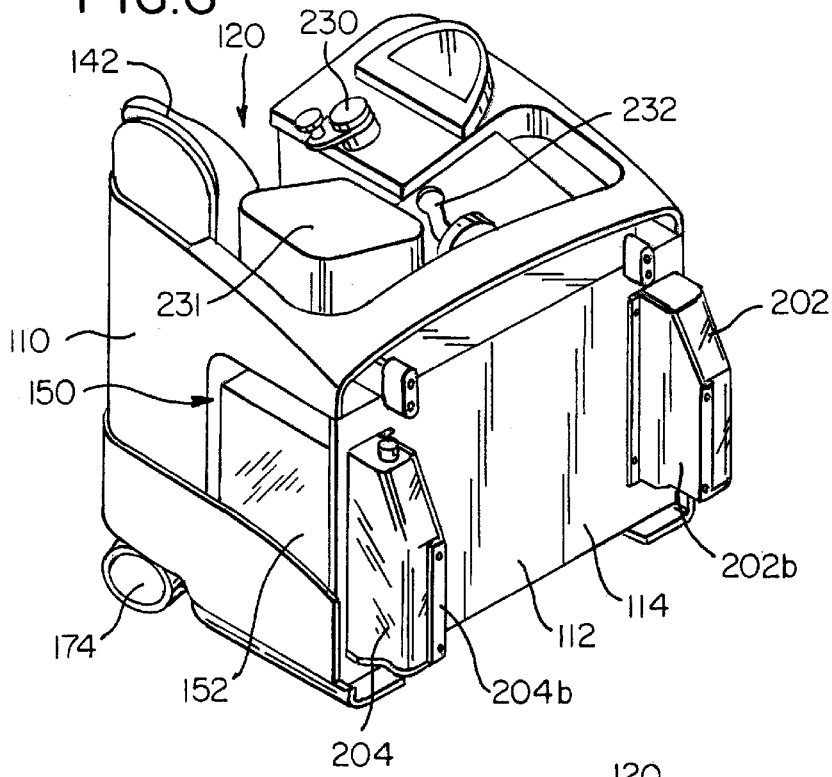
FIG. 6 is perspective view of the power unit of the truck illustrated in FIG. 1 with a portion of its outer panels removed.

The operator's compartment 320 is placed at the right rear of the truck 300 (with the front of the vehicle being in the direction of the forks), see FIG. 11. An operator stands or sits in the compartment 320 with a left hand on a steering control 330 and a right hand on a control handle 332, which controls the vehicle speed, direction of travel, the raising and lowering of the forks 390 and other axillary functions, such as fork extension and side shift, see FIG. 12. The operator's back is supported by an operator's back rest 342.

The first equipment compartment 330 is located in the left rear comer of the power unit 310. The second equipment compartment (not shown) includes space behind the operator's back rest 342. The third equipment compartment 345 includes space over the battery compartment 350. The fourth equipment compartment 347 is located on a right side 311 of the power unit 310 and forward of the operator's compartment 310.

The truck 300 further includes a hydraulic pump system 400. The pump system 400 comprises the two hydraulic motor/pump assemblies 370 and 372, which are located in the fourth equipment compartment 347, see FIGS. 11 and 12. It further includes one fluid reservoir 302, a manifold 410 and conduits (not shown) coupling the motor/pump assemblies 370, 372 and the reservoir 302 to the manifold 410. A drip shelf 430 is provided between the manifold 410 and the motor/pump assemblies 370, 372 to prevent hydraulic fluid, which may leak from the manifold 410, from reaching the motor/pump assemblies 370 and 372.

Figure 15:
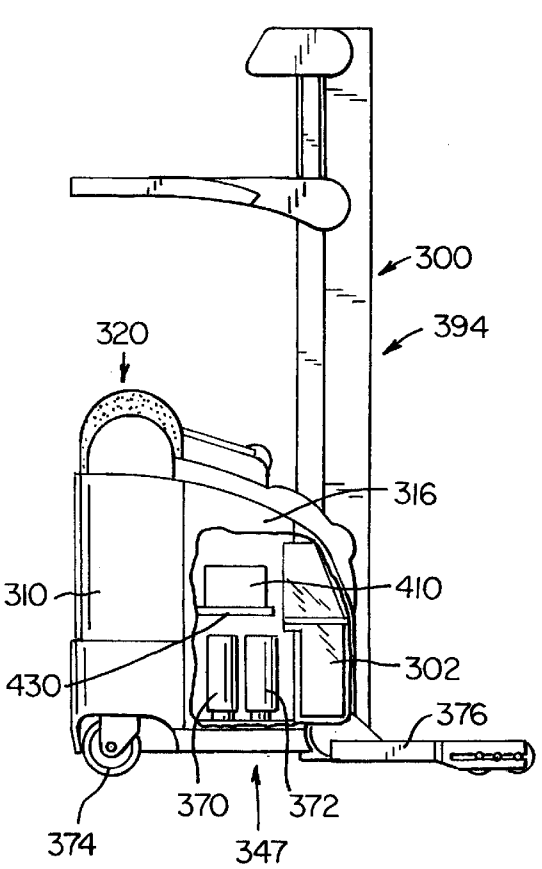
FIG. 15 is a right side view of the truck illustrated in FIG. 11, with a portion removed.
Figure 14:
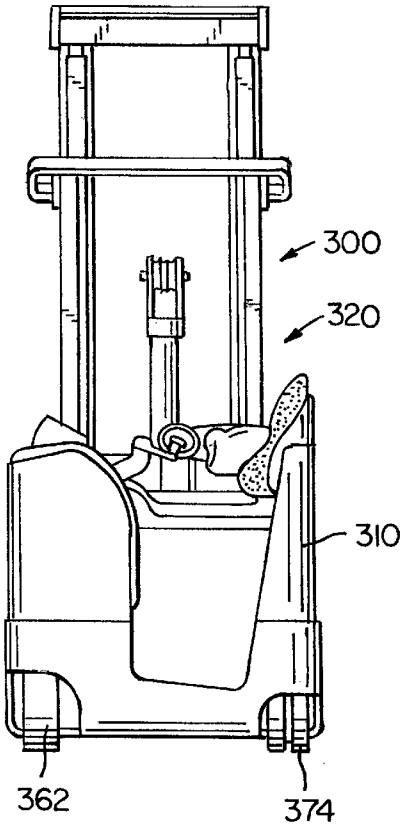
FIG. 14 is a rear view of the truck illustrated in FIG. 11.

The fluid reservoir 302 is located laterally of the mast assembly 394, see FIGS. 11 and 15. More specifically, it is located in the front right hand corner 311*a* of the power unit 310. A bracket 314 is coupled to the power unit 310. The fluid reservoir 302 sits in the bracket 314 and is secured in position via a strap 315. An outer panel 316 of the power unit 310 covers the fluid reservoir 302.

The pump system 300 also includes a flat-pack electronic controller 312 which controls the operation of the motor/pump assemblies 370, 372. The controller 312 is located in the third equipment compartment 345. As the controller 312 has only a limited thickness in a Z-direction, see FIG. 13, it does not appreciably restrict an operator's forward visibility.

The traction motor/brake assembly controller 364 is mounted adjacent a left side of the mast assembly 394 and is coupled to the power unit 310, see FIG. 11.

An electronic package (not shown) that includes fuses is located behind the operator's back rest 342. This package is considerably reduced in dimension over a similar package provided in the above-discussed prior art truck, and allows the operator's back to be placed closer to the right side of the vehicle.

The power unit 310 of truck 300 has a lowered profile as a result of relocating some of the power unit components, as described above. Hence, the area of limited visibility in front of the truck 300 is reduced when compared to that of a prior art truck.

The truck 300 illustrated in FIGS. 11–15 is a 48" fork lift truck. That is, the power unit 310 spans 48 inches across its rear portion.

With regard to both trucks 100 and 300, the upper surface of each power unit 110, 310 slopes downwardly from the operator's compartment 120, 320 toward the front wall of the power unit 110, 310 to permit improved operator visibility.

What is claimed is:

1. A fork lift truck comprising:

a power unit including an operator's compartment and at least one equipment compartment;

a pair of forks;

a fork carriage assembly coupled to said forks;

a mast assembly coupled to said fork carriage assembly and said power unit for vertically moving said fork carriage assembly including said forks relative to said power unit; and a hydraulic pump system having at least one hydraulic motor/pump assembly mounted in said at least one equipment compartment and at least one fluid reservoir located laterally of said mast assembly.

2. A fork lift truck as set out in claim 1, wherein said at least one fluid reservoir comprises a pair of fluid reservoirs, one fluid reservoir being located on each side of said mast assembly and being located adjacent an outer surface of a front wall of said power unit.

3. A fork lift truck as set out in claim 2, wherein said equipment compartment is located in a rear corner of said power unit opposite said front wall of said power unit.

4. A fork lift truck as set out in claim 1, wherein said at least one equipment compartment comprises first and second equipment compartments, said first equipment compartment being located in a rear corner of said power unit and housing a traction motor/brake assembly coupled to a wheel which together effect movement of said power unit, said second equipment compartment being located on a side of said power unit and forward of said operator's compartment.

5. A fork lift truck as set out in claim 4, wherein said at least one fluid reservoir comprises a fluid reservoir located on a front corner of said power unit adjacent said second equipment compartment and laterally of said mast assembly.

6. The fork lift truck as set out in claim 1, wherein said at least one fluid reservoir is mounted adjacent to a front wall of said power unit to reduce heat transfer from said reservoir to said operator's compartment.

7. The fork lift truck as set out in claim 1, wherein said at least one fluid reservoir is mounted forward of said operator's compartment.

8. A fork lift truck comprising:

a power unit including an operator's compartment, at least one equipment compartment, and a battery compartment housing a battery located forward of said operator's compartment, said height of at least a portion of said power unit being limited to approximately the height of said battery compartment;

a pair of forks;

a fork carriage assembly coupled to said forks;

a mast assembly coupled to said fork carriage assembly and said power unit for vertically moving said fork carriage assembly including said forks relative to said power unit; and a hydraulic pump system having at least one hydraulic motor/pump assembly mounted in said at least one equipment compartment, at least one fluid reservoir, and a manifold, said at least one fluid reservoir being located laterally of said mast assembly.

9. A fork lift truck as set out in claim 8, wherein said at least one fluid reservoir comprises two fluid reservoirs with one fluid reservoir being located on each side of said mast assembly and being coupled to an outer surface of a front wall of said power unit.

10. A fork lift truck as set out in claim 9, wherein said equipment compartment is located in a rear corner of said power unit opposite said front wall of said power unit.

11. A fork lift truck as set out in claim 10, wherein said manifold is mounted above said battery compartment forward of said operator's compartment and positioned along a first edge of said power unit such that the height of said power unit from a second edge of said power unit opposite to said first edge to said manifold is limited to approximately the height of said battery compartment.

12. A fork lift truck as set out in claim 8, wherein said at least one equipment compartment comprises first and second equipment compartments, said first equipment compartment being located in a rear corner of said power unit and housing a traction motor/brake assembly coupled to a wheel which together define a drive mechanism for effecting movement of said power unit, said second equipment compartment being located on a side of said power unit and forward of said operator's compartment.

13. A fork lift truck as set out in claim 12, wherein said second equipment compartment is located in line with said battery compartment.

14. A fork lift truck as set out in claim 13, wherein said at least one hydraulic motor/pump assembly comprises a pair of hydraulic motor/pump assemblies mounted in said second equipment compartment.

15. A fork lift truck as set out in claim 14, wherein said fluid reservoir is located on a front corner of said power unit adjacent said second equipment compartment and laterally of said mast assembly.

16. A fork lift truck as set out in claim 15, wherein said manifold is mounted above said pair of hydraulic motor/pump assemblies and said power unit further includes a drip shelf positioned between said manifold and said motor/pump assemblies.

17. A fork lift truck as set out in claim 8, wherein an upper surface of said power unit slopes downwardly from said operator's compartment toward a front wall of said power unit to permit improved operator visibility.

18. The fork lift truck as set out in claim 8, wherein said at least one fluid reservoir is mounted forward of said operator's compartment.

* * * * *